US011002047B2

(12) United States Patent
French et al.

(10) Patent No.: US 11,002,047 B2
(45) Date of Patent: May 11, 2021

(54) VEHICLE HOOD HINGE

(71) Applicant: CVF Motorsports, Inc., New Prague, MN (US)

(72) Inventors: Nathan H. French, Webster, MN (US); Erik Paddock, Northfield, MN (US)

(73) Assignee: CVF MOTORSPORTS, INC., New Prague, MN (US)

( * ) Notice: Subject to any disclaimer, the term of this patent is extended or adjusted under 35 U.S.C. 154(b) by 0 days.

(21) Appl. No.: 16/539,806

(22) Filed: Aug. 13, 2019

(65) Prior Publication Data

US 2020/0056410 A1 Feb. 20, 2020

Related U.S. Application Data

(60) Provisional application No. 62/718,653, filed on Aug. 14, 2018.

(51) Int. Cl.
*E05D 7/06* (2006.01)
*E05D 7/04* (2006.01)
*E05D 3/06* (2006.01)

(52) U.S. Cl.
CPC ..... *E05D 7/04* (2013.01); *E05D 3/06* (2013.01); *E05Y 2900/536* (2013.01)

(58) Field of Classification Search
CPC ..... E05D 7/04; E05D 7/0045; E05D 7/0054; E05D 7/0415; E05D 7/0423; E05D 7/0027; E05D 2007/0063; E05D 2007/0072; E05D 3/02; E05D 3/06; E05Y 2900/148; E05Y 2900/536; Y10T 16/5324; Y10T 16/532; Y10T 16/53253; Y10T 16/53225
See application file for complete search history.

(56) References Cited

U.S. PATENT DOCUMENTS 1,044,055 A * 11/1912 Johnson et al. .... E05D 11/1078 403/107
2,373,955 A * 4/1945 Fuller ..... E05D 7/0423 16/238

(Continued)

FOREIGN PATENT DOCUMENTS

CN 206320169 U * 7/2017
EP 1201171 A1 * 5/2002 ..... E05D 7/0415

(Continued)

OTHER PUBLICATIONS

Eddie Motorsports 2017 Hinges on Website, 1 pg.

(Continued)

*Primary Examiner* — Chuck Y Mah
(74) *Attorney, Agent, or Firm* — Fredrikson & Byron, P.A.

(57) ABSTRACT

A hood hinge is disclosed herein. The hood hinge includes a body attachment member configured to be attached to a vehicle body, and a hood attachment member configured to be attached to a vehicle hood. The hood further includes a hinge mechanism connected to the body attachment member and the hood attachment member so as to enable hinged movement of the hood relative to the body. Also provided are methods for installing a hood in a vehicle. Many embodiments include structural features that make it easier to make small adjustments to the position of the vehicle hood relative to the vehicle body to ensure optimum fit.

22 Claims, 8 Drawing Sheets

(56) References Cited

U.S. PATENT DOCUMENTS 3,006,443 A * 10/1961 Siler ..... F16B 43/00 403/408.1
3,234,584 A * 2/1966 Valade ..... E05F 1/1276 16/370
4,490,883 A * 1/1985 Gauron ..... E05D 3/022 16/245
5,074,609 A * 12/1991 Dear ..... E05D 7/0423 296/76
5,158,333 A * 10/1992 Saville ..... E05D 7/0423 16/238
5,580,201 A * 12/1996 Brilmyer ..... B62D 17/00 411/169
5,799,370 A * 9/1998 Davidian ..... E05D 7/0415 16/236
5,967,586 A * 10/1999 Duffy ..... E05D 7/0045 16/235
6,202,255 B1 * 3/2001 Sitter ..... E05D 7/0415 16/239
6,286,185 B1 * 9/2001 Ramsauer ..... E05D 7/04 16/236
6,434,791 B1 * 8/2002 Chung ..... E05D 7/0423 16/251
6,701,572 B2 * 3/2004 Bechthold ..... E05D 7/0045 16/235
6,725,504 B1 * 4/2004 Dickson ..... E05D 7/04 16/236
7,228,597 B2 * 6/2007 Gerali ..... E05D 7/12 16/254
7,516,517 B2 * 4/2009 Fries ..... E05D 7/02 16/246
7,748,081 B2 * 7/2010 Ganter ..... E05D 7/04 16/235
D645,478 S 9/2011 Iwanicki
8,555,464 B2 * 10/2013 Bannon ..... E05D 7/0415 16/237
D726,637 S 4/2015 Ring et al.
9,631,546 B2 4/2017 Huckey
2002/0073509 A1 * 6/2002 Dean ..... E05D 7/0415 16/387
2003/0159247 A1 * 8/2003 Schott ..... E05D 5/062 16/244
2009/0271947 A1 * 11/2009 Krajenke ..... E05D 7/0423 16/241
2016/0153221 A1 * 6/2016 Dodge ..... E05D 7/0415 16/238

FOREIGN PATENT DOCUMENTS

EP 1394000 A1 * 3/2004 ..... B62D 25/105
EP 1767734 A2 * 3/2007 ..... E05D 7/0054

OTHER PUBLICATIONS

All American Billet Catalog 2017, 1 pg.
Billet Specialties Advertisement from Catalog. vol. 29, 2017, 1 pg.
Eddie Motorsports Catalog Advertisement, 2016-2017, 1 pg.
Youtube video from May 30, 2014, "Why we created the Billet Hood Hinge and Ohter Billet and Carbon Fiber Products," retrieved on Nov. 21, 2019: https://www.youtube.com/watch?v=jC1DEIZ9c2Y, 2 pgs.
Youtube video from Mar. 29, 2016, "Eddie Motorsports Billet Hood Hinge Installation," retrieved on Nov. 21, 2019: https://www.youtube.com/watch?v=1W22VX_4FXE, 2 pgs.

* cited by examiner

VEHICLE HOOD HINGE

CROSS-REFERENCE TO RELATED APPLICATIONS

This application claims the benefit of U.S. Provisional Application No. 62/718,653, filed Aug. 14, 2018, the contents of which are incorporated herein by reference.

TECHNICAL FIELD

This disclosure relates generally to adjustable hinges for vehicle hoods. This disclosure also provides methods of installing a hood on a vehicle using such a vehicle hood hinge.

BACKGROUND

Known hinges for attaching hoods to vehicles have limited adjustment. This adjustment is usually accomplished using loose tolerance on bolt holes and/or slots in the holes for bolts that connect the hood and the body of the vehicle to the hinge. This can be very time-consuming as it typically requires multiple iterations by a team of installers to fine-tune gaps between body panels and the hood of the vehicle.

Another known solution for automotive hinge alignment is to use shims to fine-tune fit of the hood. This is also a time-consuming and iterative process that requires the installation team to remove the hinge, add shims, and re-install the hinge.

SUMMARY

An adjustable hood hinge is disclosed herein. The hood hinge of the present disclosure allows for a larger range of adjustment than with conventional hood hinges. Advantageously, the illustrative hood hinge enables fast and accurate adjustment of a position of a vehicle hood through the use of cams and adjusting screws. In particular, in some embodiments, cams enable easy adjustment of the hood from left to right, and the threaded fasteners and bolts allow for easy and repeatable adjustment of the hood backward and forward. The cams also allow for greater length of adjustment than with oversized slots. In addition, an open slot on the hood attachment member can advantageously allow a single person to install the hood.

The hood hinge may include a body attachment member configured to be attached to a vehicle body, and a hood attachment member configured to be attached to a vehicle hood. The hood hinge may further include a hinge mechanism connected to the body attachment member and the hood attachment member so as to enable hinged movement of the hood relative to the body.

To install a hood in a vehicle using such a hood hinge, both a driver-side hood hinge and a passenger-side hood hinge are provided. An installer can attach the driver-side hood hinge to a driver side of the vehicle body and can attach the passenger-side hood hinge to a passenger side of the vehicle body. The installer can then attach the front hood attachment bolts to the driver-side and passenger-side of the vehicle hood, and attach the vehicle hood to the driver-side and passenger-side hood hinges' hood attachment members. The installer can adjust one or more cam buttons, adjust one or more threaded fasteners, or can make some other positional adjustment if the hood position needs adjusting.

Inventive principles described herein may be incorporated into a variety of different hood hinge configurations. The details of one or more examples are set forth in the accompanying drawings and the description below. Other features, objects, and advantages will be apparent from the description and drawings.

BRIEF DESCRIPTION OF DRAWINGS

The following drawings are illustrative of particular embodiments of the present invention and therefore do not limit the scope of the invention. The drawings are not necessarily to scale (unless so stated) and are intended for use in conjunction with the explanations in the following description. Embodiments of the invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides some practical illustrations for implementing exemplary embodiments of the present invention. Examples of constructions, materials, and/or dimensions are provided for selected elements. Those skilled in the art will recognize that many of the noted examples have a variety of suitable alternatives.

Figure 1:
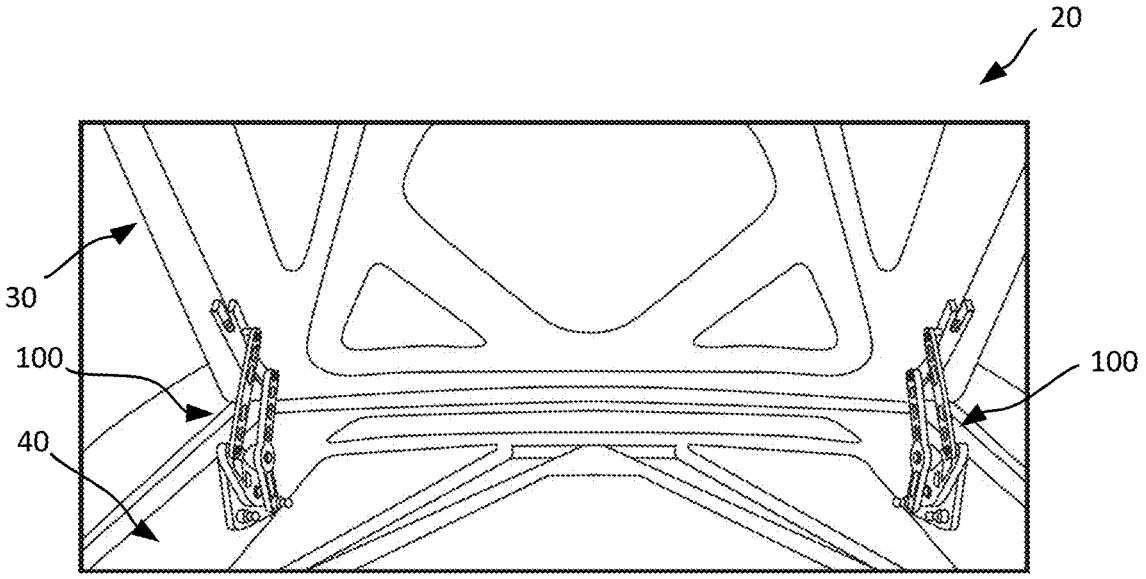
FIG. 1 is a front view of a vehicle, showing a hood of the vehicle open and two illustrative hood hinges each attached to the vehicle.

FIG. 1 shows a pair of illustrative hood hinges each generally represented by reference numeral 100. As shown in FIG. 1, each hood hinge 100 is configured to be attached to a vehicle 20 so as to allow a hood 30 of the vehicle 20 to open and close relative to a body 40 of the vehicle 20. In use, one hood hinge 100 is attached to a driver-side of the body 40 of the vehicle 20, and the other hood hinge 100 is attached to a passenger-side of the body 40 of the vehicle 20.

Figure 2:
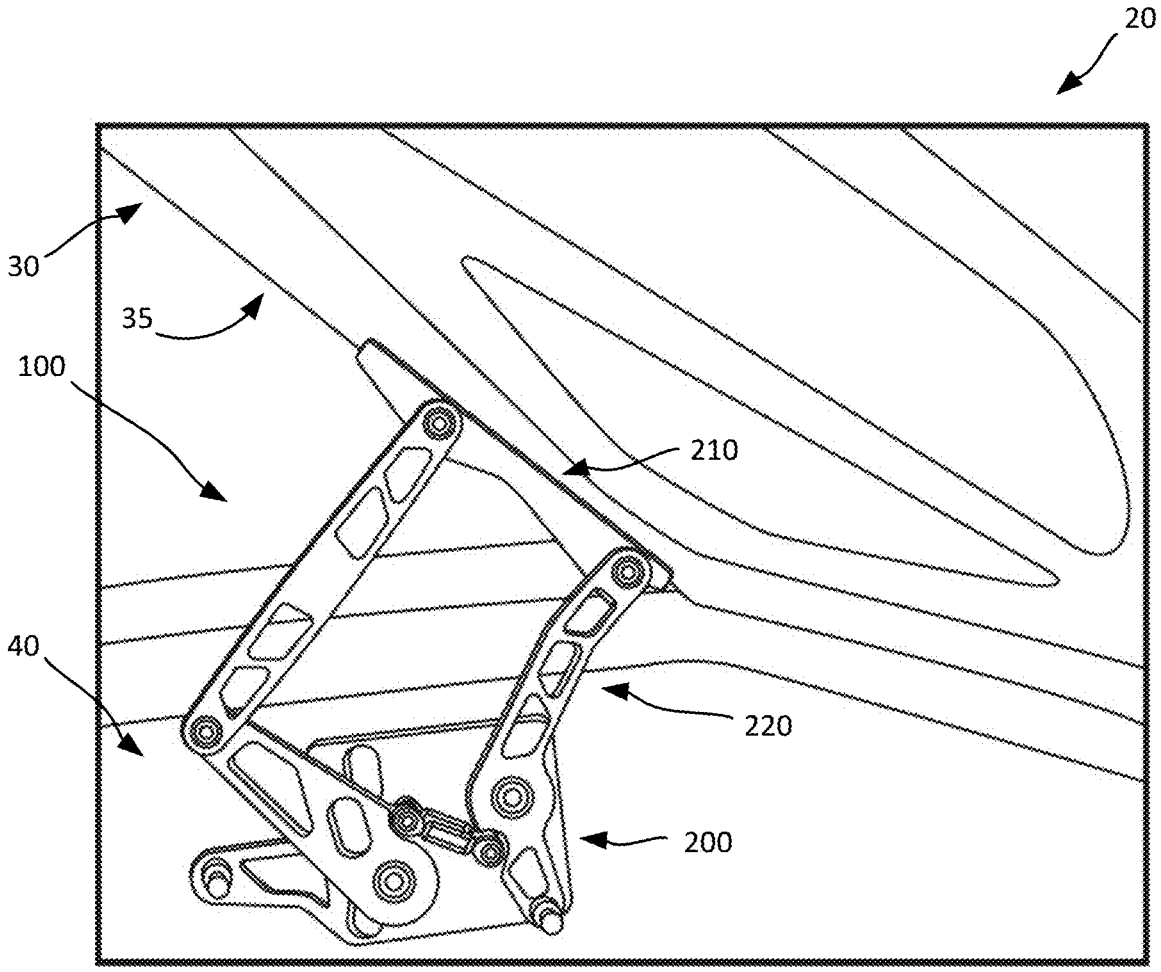
FIG. 2 is a front view of an illustrative hood hinge attached to both a body and a hood of a vehicle.

As shown in FIG. 2, each hood hinge 100 comprises a body attachment member 200 and a hood attachment member 210. The body attachment member 200 is configured to be attached to the body 40 of the vehicle 20, whereas the hood attachment member 210 is configured to be attached to the hood 30 of the vehicle 20. In some cases, e.g., as shown in FIG. 2, the hood attachment member 210 is configured to be attached to an underside 35 of the hood 30.

Figure 3A:
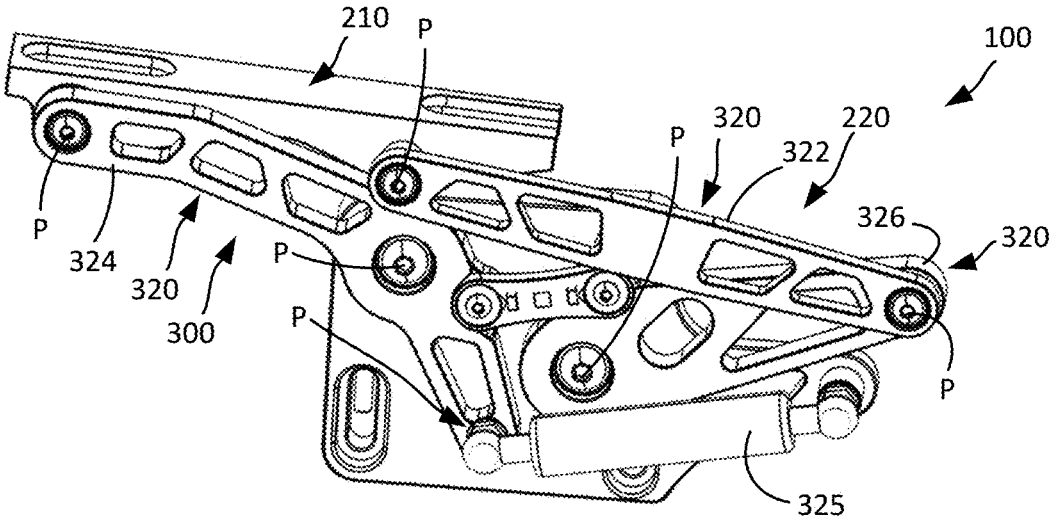
FIG. 3A is a front perspective view of an illustrative hood hinge, showing the hinge mechanism in a closed position.
Figure 3B:
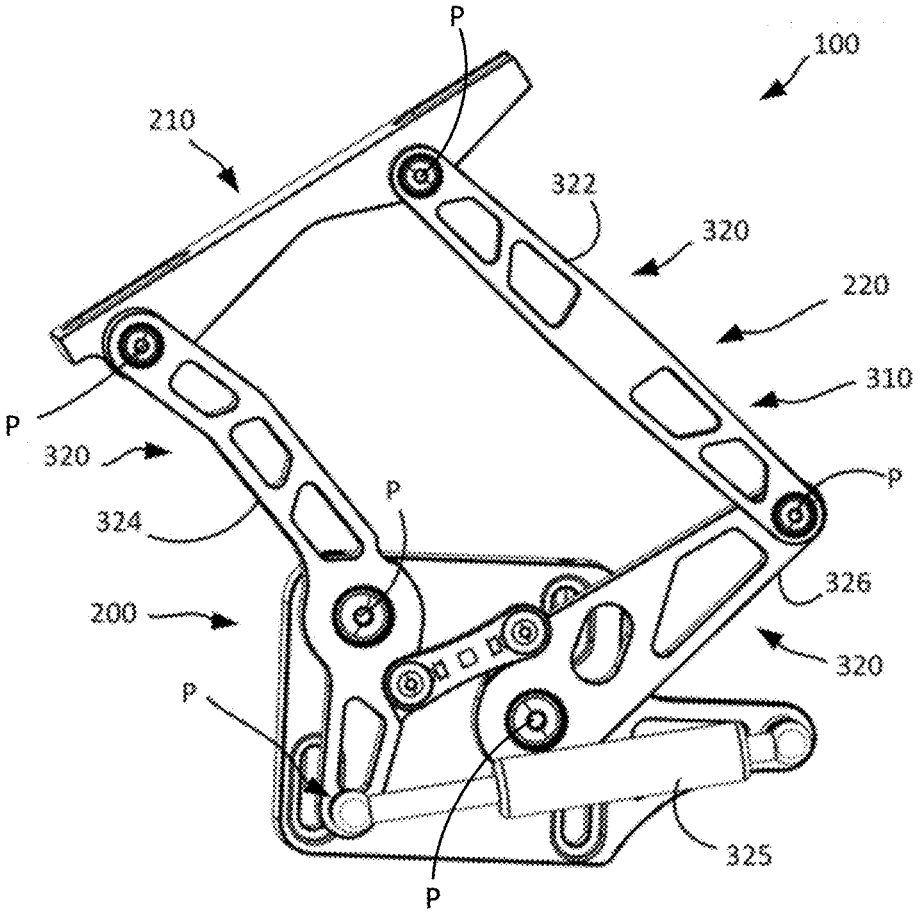
FIG. 3B is a rear perspective view of an illustrative hood hinge, showing the hinge mechanism in an open position.

As shown in FIGS. 2, 3A, and 3B, each hood hinge 100 also comprises a hinge mechanism 220 connected to both the body attachment member 200 and the hood attachment member 210. The hinge mechanism 220 is configured to enable hinged movement of the hood 30 relative to the body 40. As shown in FIGS. 3A and 3B, the hinge mechanism 220 can comprise a plurality of arms 320 that are pivotable about a plurality of respective pivot points P. For instance, the plurality of arms 320 can include a first arm 322, a second arm 324, and a third arm 326. In embodiments of this nature, the first arm 322 can be hingedly connected to the third arm 326, and the third arm 326 can be hingedly connected to the second arm 324. In addition, the first arm 322 and the second arm 324 can each be hingedly connected to the hood attachment member 210, while the second arm 324 and the third arm 326 are each hingedly connected to the body attachment member 200.

As can be appreciated by comparing FIGS. 3A and 3B, the hinge mechanism 220 is movable between a closed position 300 (FIG. 3A) and an open position 310 (FIG. 3B). When the hinge mechanism 220 is in the closed position 300, the hood attachment member 210 is located nearer to the body attachment member 200 than when the hinge mechanism is in the open position 310. When the hinge mechanism 220 is attached to the vehicle as described herein, the hinge mechanism 220 is movable from the open position 310 to the closed position 300 when the hood of the vehicle is being closed.

As shown in FIGS. 3A-3B, a spring 325 can be provided and attached to each hood hinge 100. Such spring 325 may be configured to facilitate raising and lowering the hood, as well as retaining the hood in an open position 310. Spring 325 of FIGS. 3A-3B comprises a gas spring, though other kinds of springs may be used in other embodiments.

Figure 4A:
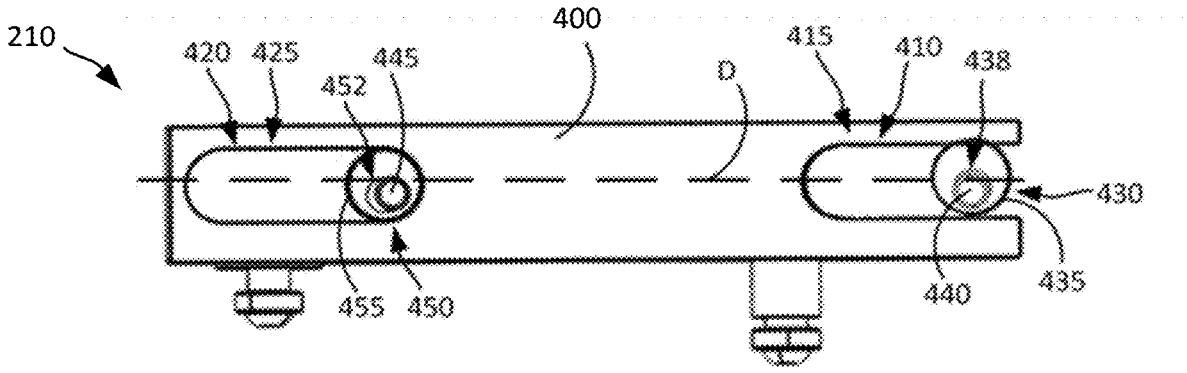
FIG. 4A is a top view of a hood attachment member of an illustrative hood hinge, showing the first and second cam buttons in downward positions.
Figure 4B:
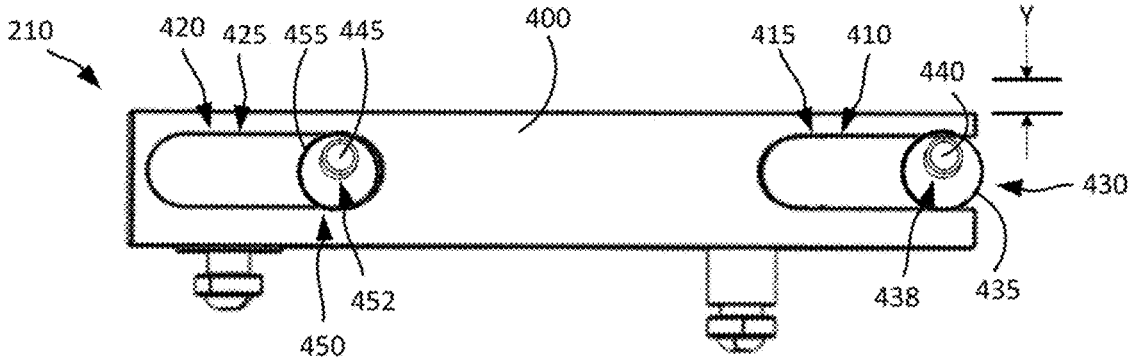
FIG. 4B is a top view of a hood attachment member of an illustrative hood hinge, showing the first and second cam buttons each rotated into upward positions.
Figure 4C:
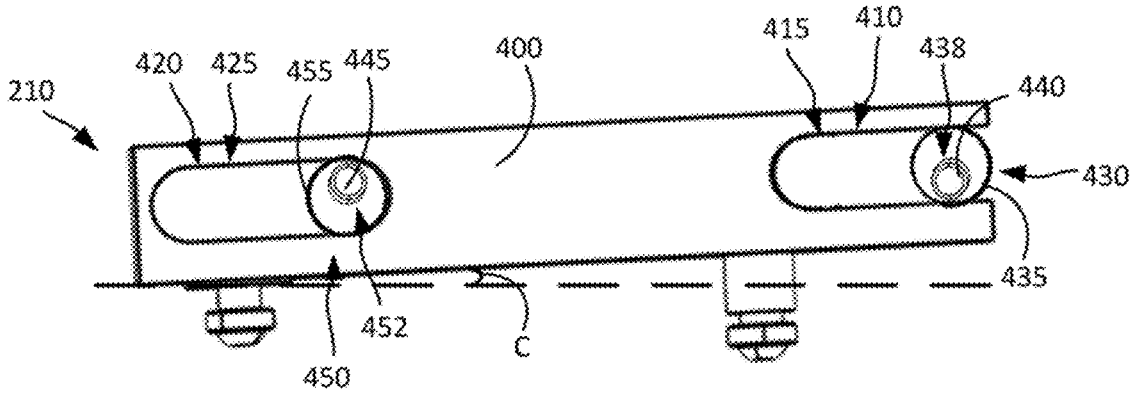
FIG. 4C is a top view of a hood attachment member of an illustrative hood hinge, showing the second cam button in an upward position and the first cam button rotated into a downward position.

In more detail, the hood attachment member 210 may include a hinge arm 400 configured to attach to the hood of a vehicle. As shown in FIGS. 4A-4C, the hinge arm 400 may include a first attachment opening 410 and a second attachment opening 420.

The hood attachment member 210 can include a first cam assembly 430 configured to allow adjustment of the hood from side to side relative to a vehicle body. As shown in FIGS. 4A-4C, the first cam assembly 430 may include a first cam button 435 and a first bolt 440. The first bolt 440 can extend through an opening 438 in the first cam button 435. The first bolt 440 may be configured to attach the hinge arm 400 to the hood of the vehicle while positioning the first cam button 435 in the first attachment opening 410. The first cam assembly 430 may be configured to permit controlled adjustment of a position of the hood relative to the hinge arm 400 in a first direction perpendicular to a longitudinal axis D of the hood attachment member 210.

As shown in FIGS. 4A-4C, the hood attachment member 210 can include a second cam assembly 450. The second cam assembly 450 may include a second cam button 455 and a second bolt 445. In such embodiments, the second bolt 445 can extend through an opening 452 in the second cam button 455 and can be configured to position the second cam button 455 in the second attachment opening 420. The second cam assembly 450 is configured to permit adjustment of the position of the hood relative to the hinge arm 400 in the first direction, independent of the first cam assembly 430 permitting adjustment of the position of the hood relative to the hinge arm 400 in the first direction. In some embodiments, by virtue of the first cam assembly 430 and second cam assembly 450, the illustrative hood hinge 100 may allow for 0.125 inch adjustment in both directions perpendicular to longitudinal axis D for a total adjustable range of 0.25 inches.

FIG. 4A shows the first and second cam buttons 435, 455 each in a first position, with cam bolts 440, 445 facing downward on the page, whereas FIG. 4B shows the first and second cam buttons 435, 455 each rotated 180 degrees into a second position, with cam bolts 440, 445 facing upward on the page. This rotation of the first and second cam buttons 435, 455 (from the position shown in FIG. 4A to the position shown in FIG. 4B) may configured to adjust the position of the hood relative to the hinge arm 400 by a distance Y.

As can be appreciated by comparing FIGS. 4B and 4C, by positioning the first cam button 435 and the second cam button 455 in opposite directions (e.g., such that the first cam bolt 440 is positioned downwardly and the second cam bolt 445 is positioned upwardly), the angle C of the hood relative to the hinge arm 400 can be adjusted. Advantageously, this adjustment can help properly align the position of the hood in the vehicle body's hood opening.

Adjustment of the first and second cam assemblies 430, 450 can permit fine tuning of the position of the hinge arm 400 relative to the hood. For example, the hood may be manually translated slightly in a side-to-side direction, and the first and second cam buttons 435, 455 may be rotated about the respective cam bolts 445, 440 until the hood fits well with the vehicle's hood opening, and then the cam bolts 445, 440 may be tightened. In another example, the hood may be manually rotated slightly at a particular angle, and the first cam button 435 and/or the second cam button 455 may be rotated about the respective cam bolts 445, 440 until the hood fits well with the vehicle's hood opening, and then the cam bolts 445, 440 may be tightened. In some instances, the hood may be translated side to side and rotated, and the first cam button 435 and/or the second cam button 455 may be rotated about the respective cam bolts 445, 440 until the hood fits well with the vehicle's hood opening, and then the cam bolts 445, 440 may be tightened.

Figure 5A:
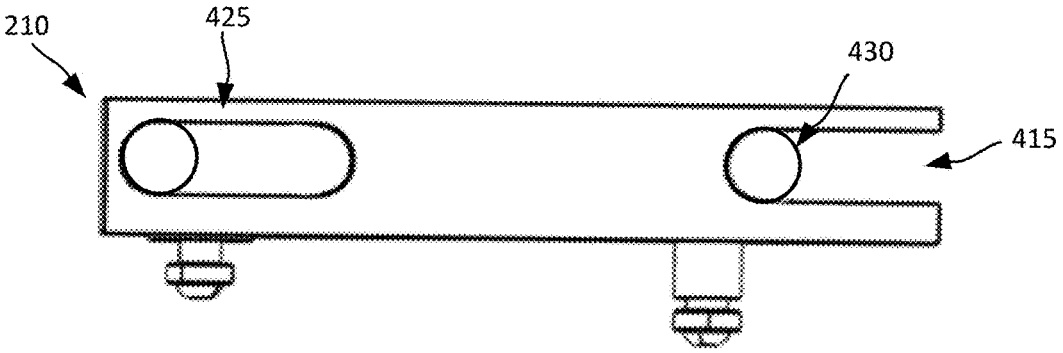
FIG. 5A is a top view of a hood attachment member of an illustrative hood hinge.
Figure 5B:
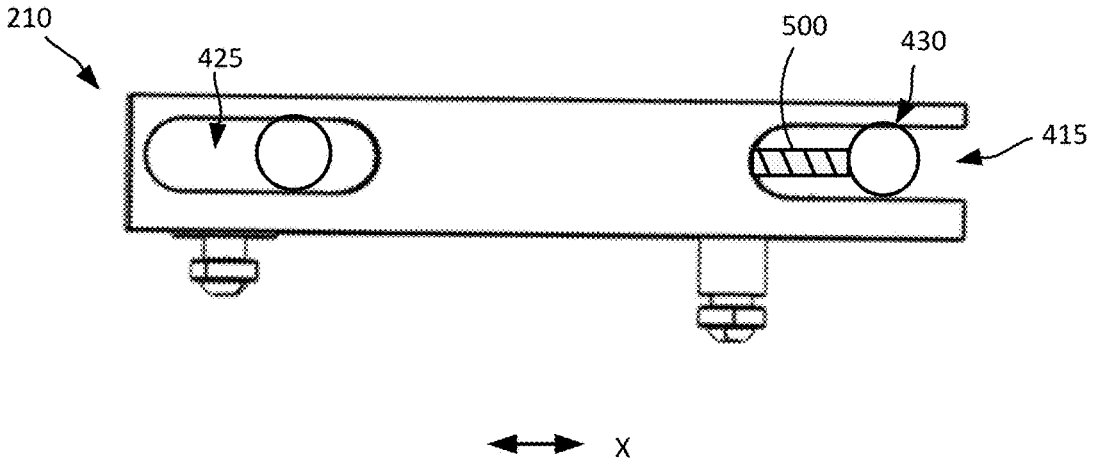
FIG. 5B is a top view of a hood attachment member of an illustrative hood hinge, showing the hood attachment member threaded fastener pressing into the first cam assembly.

FIGS. 5A-5B show how the first attachment opening may comprises a first attachment slot 415 and how the second attachment opening may comprise a second attachment slot 425. The first attachment slot 415 and the second attachment slot 425 may be configured to permit adjustment of the position of the hood relative to the hinge arm 400 in the X direction (parallel with the longitudinal axis of the hood attachment member). For example, the hood may be translated in a front-to-back (or back-to-front) direction until the hood fits well in the vehicle's hood opening, and the cam bolts 445, 440 may be tightened.

FIGS. 5A-5B show how a hood attachment member threaded fastener 500 may be incorporated into some embodiments of the hood attachment member 210. As shown in FIG. 5B, the hood attachment member threaded fastener 500 may extend into the first attachment slot 415. The hood attachment member threaded fastener 500 can be configured to press the first cam assembly 430 to facilitate controlled adjustment of the position of the hood relative to the hinge arm 400 in the X direction. For example, the hood may be translated in a front-to-back (or back-to-front) direction until the hood fits generally well in the vehicle's hood opening, and then the hood attachment member threaded fastener 500 may be extended or retracted to press the first cam assembly 430, thereby facilitating an even better fit. As can be appreciated, the hood attachment member threaded fastener 500 is not visible in FIG. 5A, as it is fully retracted into the hood attachment member 210. In many embodiments, the hood attachment member threaded fastener 500 comprises a set screw.

Figure 6A:
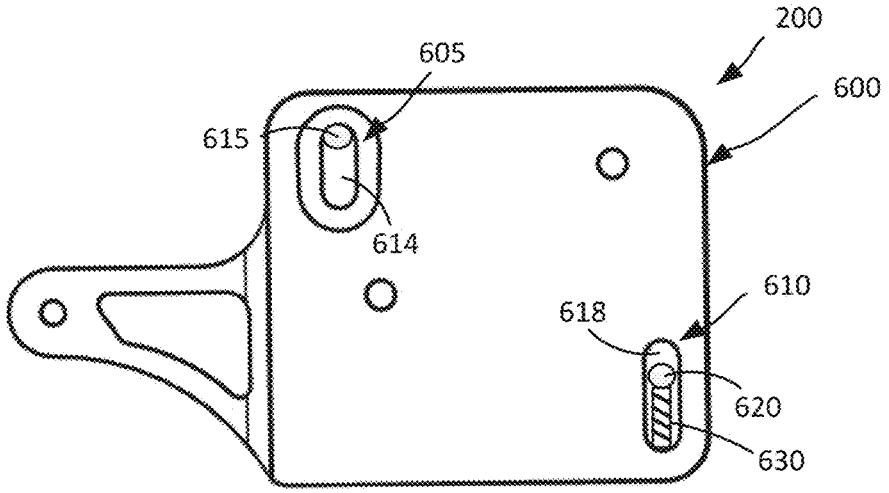
FIG. 6A is a rear view of a base of an illustrative hood hinge having two body attachment openings, showing a second body attachment member threaded fastener pressing into a second body attachment bolt, with the first body attachment member threaded fastener being fully retracted into the base.
Figure 6B:
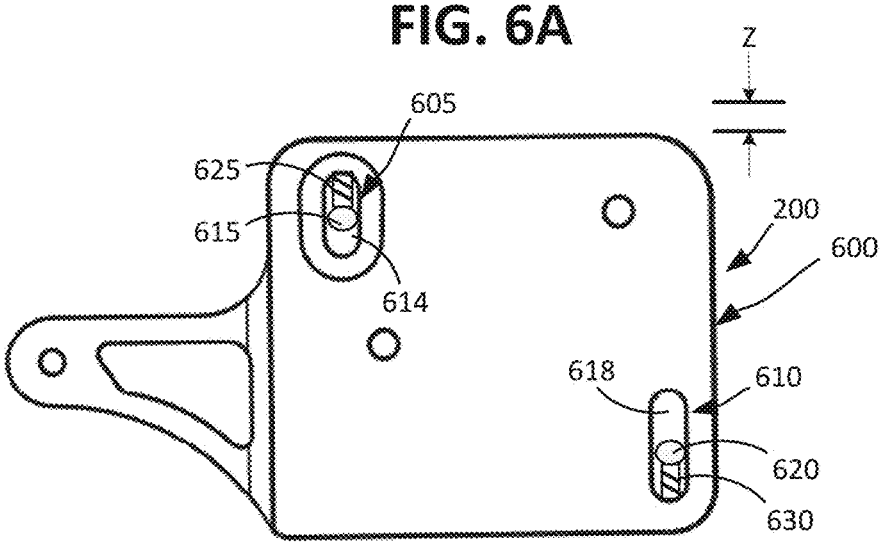
FIG. 6B is a rear view of a base of an illustrative hood hinge similar to FIG. 6B, except showing the first body attachment member threaded fastener extending into the first body attachment opening, and the second body attachment member threaded fastener retracted further into the base than shown in FIG. 6A.
Figure 6C:
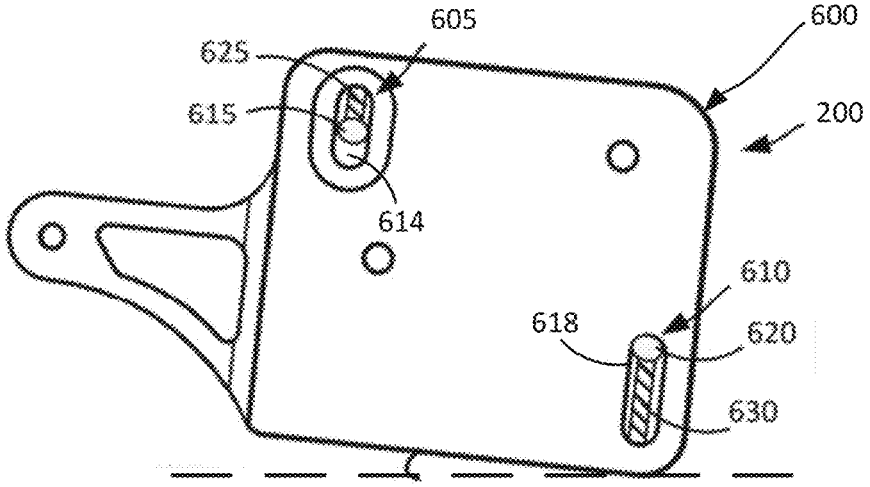
FIG. 6C is a rear view of a base of an illustrative hood hinge similar to FIG. 6B, except showing the second body attachment member threaded fastener extending further into the second body attachment opening than shown in FIG. 6B.

FIGS. 6A-6C show how fine adjustments may be made to the position of a body attachment member 200 relative to a vehicle body in some embodiments. As shown, the body attachment member 200 comprises a base 600 with first and second body attachment openings 605, 610. In some cases, the first and second body attachment openings 605, 610 comprise first and second body attachment slots 614, 618. As illustrated in FIGS. 6A-6C, the base 600 can also comprise first and second body attachment bolts 615, 620. The first and second body attachment bolts 615, 620 are configured to fit in the first and second body attachment slots 614, 618, respectively, so as to attach the base 600 to the body of the vehicle.

The body attachment member 200 can also comprise first and second body attachment member threaded fasteners 625, 630 extending into the first and second body attachment slots 614, 618, respectively. In many embodiments, the first and second body attachment member threaded fasteners 625, 630 may be set screws. The first and second body attachment member threaded fasteners 625, 630 can be configured to press the first and second body attachment bolts 615, 620, respectively, to permit independent adjustment of the position of the vehicle body relative to the base 600.

FIG. 6A shows the second body attachment member threaded fastener 630 pressing into the second body attachment bolt 620, with first body attachment member threaded fastener 625 fully retracted from the first body attachment opening 605. FIG. 6B is similar to FIG. 6A, except showing the first body attachment member threaded fastener 625 extending into the first body attachment opening 605, and the second body attachment member threaded fastener 630 retracted further into the base 600 than shown in FIG. 6A. Adjusting the first and second body attachment member threaded fasteners 625, 630 in this manner (i.e., from the position shown in FIG. 6A to the position shown in FIG. 6B) is configured to adjust the position of the body relative to the base 600 by a distance Z.

FIG. 6C is similar to FIG. 6B, except showing the second body attachment member threaded fastener 630 extending further into the second body attachment opening 610 than shown in FIG. 6B. Adjusting the second body attachment member threaded fastener 630 from the position shown in FIG. 6B to the position shown in FIG. 6C is configured to permit angular adjustment of hood pitch (i.e., a rotation angle around the front drive axle of the vehicle).

As noted, the body attachment member threaded fasteners 625, 630 can permit positional adjustment of the hood relative to the vehicle body. For example, as the driver-side and passenger-side hood hinges are being installed, the hinge arms may be positioned to be general level with the hood opening in the vehicle body. To fine-tune that position, one or both of the threaded fasteners 625, 630 on one or both of the hood hinges may be adjusted to facilitate translation and/or rotation of the hood hinge(s) relative to the vehicle body. In another example, after the hood hinges are attached to the vehicle body and the hood is attached to the hood hinges, one or both of the threaded fasteners 625, 630 on one or both of the hood hinges may be adjusted to facilitate translation and/or rotation of the hood hinge(s) relative to the vehicle body. In this way, each body attachment member may be precisely positioned relative to the vehicle body.

Figure 7A:
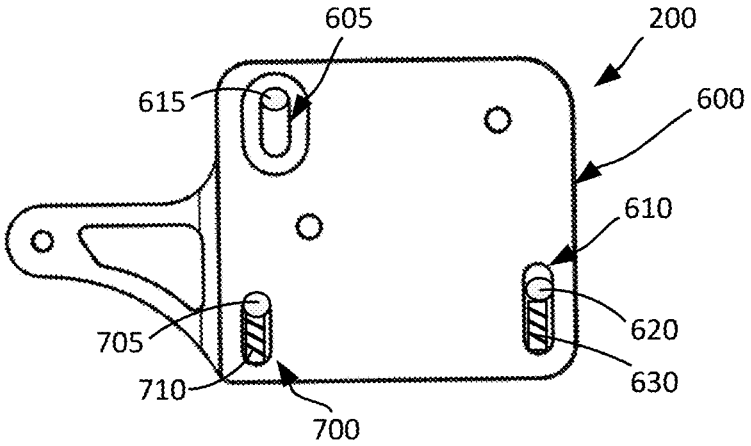
FIG. 7A is a rear view of a base of an illustrative hood hinge similar to FIG. 6A, except the hood hinge in FIG. 7A has three body attachment openings and a third attachment member threaded fastener extending into the third attachment slot.
Figure 7B:
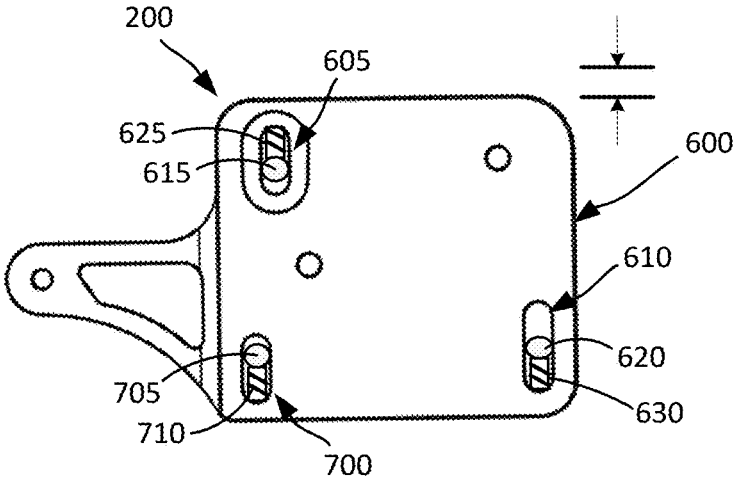
FIG. 7B is a rear view of a base of an illustrative hood hinge similar to FIG. 7A, except showing the first body attachment member threaded fastener extending into the first body attachment opening, and the second and third attachment member threaded fasteners retracted further into the base than shown in FIG. 7A.
Figure 7C:
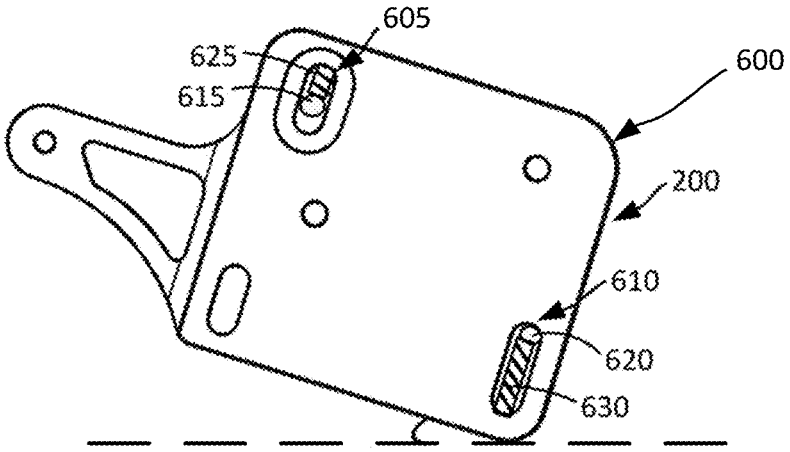
FIG. 7C is a rear view of a base of an illustrative hood hinge similar to FIG. 7B, except showing the second body attachment member threaded fastener extended further into the second body attachment opening than shown in FIG. 7B, with the third attachment member threaded fastener fully retracted into the base.

As shown in FIGS. 7A-7C, the body attachment member 200 can further include a third attachment slot 700 in the base 600. In embodiments of this nature, the body attachment member 200 may include a third attachment bolt 705 configured to fit in the third attachment slot 700 so as to attach the base 600 to the body of the vehicle.

In embodiments where a third attachment slot 700 is provided, a third attachment member threaded fastener 710 may extend into the third attachment slot 700. In some embodiments, the third attachment member threaded fastener 710 is a set screw. The third attachment member threaded fastener 710 may be configured to press the third attachment bolt 705 to permit independent adjustment of the position of the body relative to the base 600. To facilitate rotation, the third attachment bolt 705 and the third attachment member threaded fastener 710 may be removed as shown in FIG. 7C, with the body attachment member 200 functioning similarly to the body attachment member 200 of FIG. 6C. The first 615 and second 620 body attachment bolts and the third attachment bolt 705 are shown schematically in all of the figures and are not intended to show the head of the respective bolts.

Although particular embodiments have been described herein, alternative embodiments are also contemplated and within the scope of the present disclosure. In particular, any of the features described above as being part of the hood attachment member 210 can instead be part of the body attachment member 200. Similarly, any of the features described above as being part of the body attachment member 200 can be part of the hood attachment member 210. For example, in some embodiments, the first cam assembly 430 can instead be positioned in the first body attachment opening 605 of the base 600, rather than in the first attachment opening 410. The hinge arm 400 can serve as an attachment arm to be attached to either the vehicle hood or the vehicle body. In some embodiments, one or both of the openings configured to receive the cam buttons may be of similar size as the cam buttons rather than slots that facilitate translation. Some embodiments include a single cam assembly and a separate bolt rather than two cam assemblies. Some embodiments do not include a cam assembly but rather incorporate a simple bolt for attachment to the vehicle body and/or the vehicle hood. The simple bolt can extend through the opening or the slot for purposes of attachment.

Figure 8:
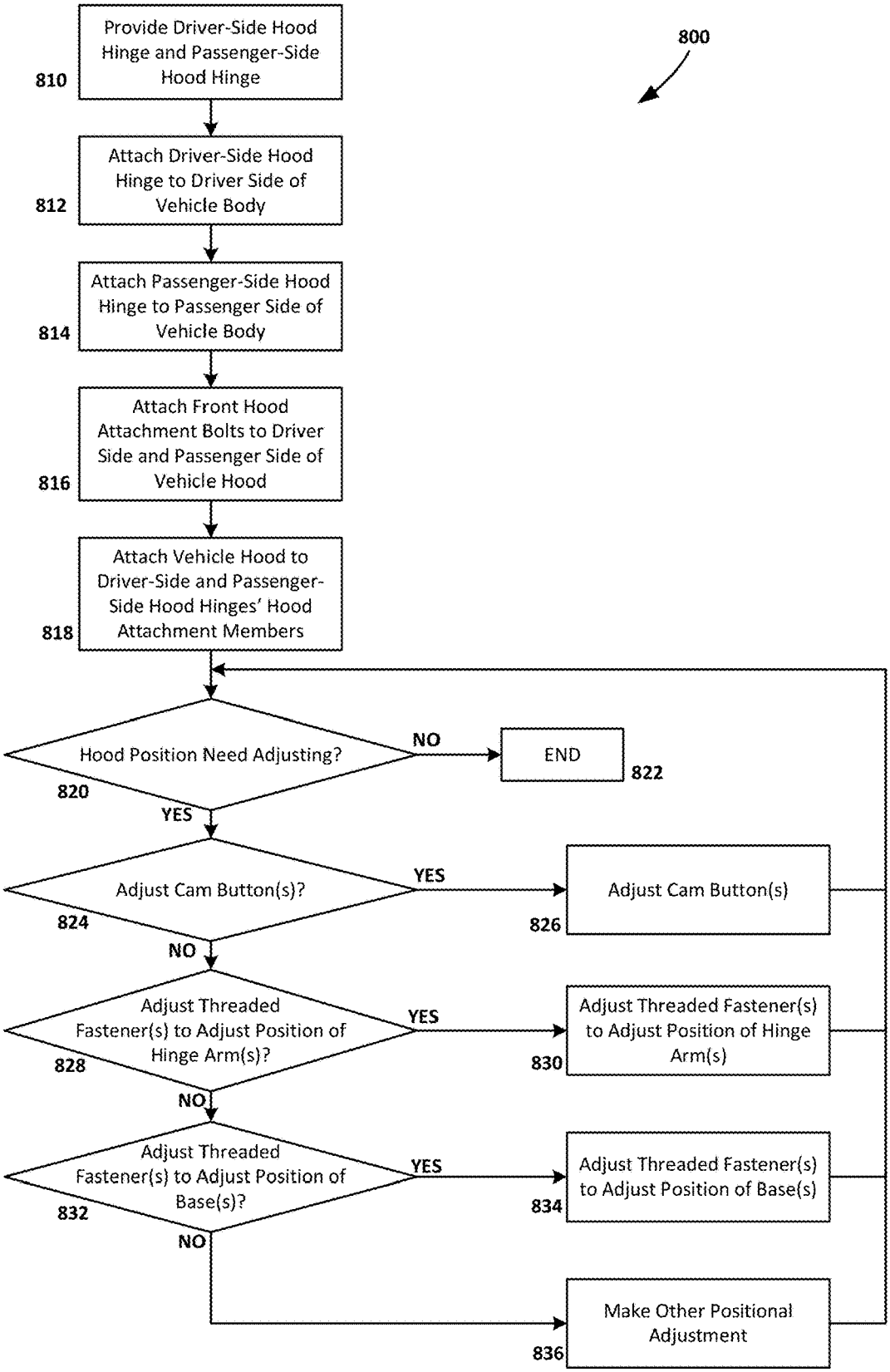
FIG. 8 is a flow chart of an illustrative method of installing a hood in a vehicle.

An illustrative method 800 of installing a hood in a vehicle is shown in FIG. 8. The method 800 can include the step 810 of providing a driver-side hood hinge and a passenger-side hood hinge. Each of the driver-side hood hinge and the passenger-side hood hinge can have the same or similar characteristics of the hood hinges described elsewhere herein.

The method can include the step 812 of attaching the driver-side hood hinge to a driver side of the vehicle body, as well as the step 814 of attaching the passenger-side hood hinge to a passenger side of the vehicle body. Step 812 can be accomplished by bolting the first and second attachment bolts of the driver-side hood hinge's body attachment member through the first and second body attachment openings, respectively, of the base of the driver-side hood hinge's body attachment member into the driver side of the vehicle body. Step 814 can be accomplished by bolting the first and second attachment bolts of the passenger-side hood hinge's body attachment member through the first and second body attachment openings, respectively, of the base of the passenger-side hood hinge's body attachment member into the passenger side of the vehicle body. Adjustments to the positions of the hood hinges may be made in accordance to techniques discussed herein while the hood hinges are attached to the vehicle body.

After the driver-side hood hinge is attached to the driver-side of the vehicle body and the passenger-side hood hinge is attached to a passenger side of the vehicle body, the method can include the step 816 of attaching the front hood attachment bolts of the driver-side hood hinge's hood attachment member and the passenger-side hood hinge's hood attachment member to a driver side of the vehicle hood and a passenger side of the vehicle hood, respectively. In many embodiments, the front hood attachment bolts can be part of cam assemblies that also include cam buttons as discussed elsewhere herein.

The method can also include the step 818 of attaching the vehicle hood to the driver-side hood hinge's hood attachment member and to the passenger-side hood hinge's hood attachment member. In some embodiments, each hood hinge attachment member can include front and rear hood attachment slots, with the front hood attachment slots being open on one end (e.g., first attachment slot 415 shown in FIGS. 4A-4C and 5A-5B). The front hood attachment bolts of the driver-side hood hinge's hood attachment member and the passenger-side hood hinge's hood attachment member can be slid into the open front ends of the respective front hood attachment slots. In embodiments with cam assemblies in the hood attachment members, when the front cam bolts and front cam buttons are attached to the vehicle hood, the front cam bolts and front cam buttons may be slid into the open-ended front hood attachment slots. With the front cam assemblies or hood attachment bolts attached to the vehicle hood and slid into the open-ended front hood attachment slots, the bolts can be tightened, and the rear hood attachment bolts (e.g., cam bolts in embodiments with rear cam assemblies) may be bolted to the hood attachment members of the driver-side and passenger-side hood attachment members through the rear hood attachment slots. This combination of sliding the hood into the front ends of the hinges and then bolting the back ends of the hinges to the hood can facilitate simpler installation, including installation by only a single person rather than by a team of people.

With the vehicle hood attached to the hood hinges, and with the hood hinges attached to the vehicle body, adjustments may be made to the position of the vehicle hood and/or the hood hinges to achieve optimum fit. As shown in FIG. 8, the method can include the step 820 of determining whether the hood position needs adjusting. If the hood position need not be adjusted, the method 800 may end at step 822. If the hood position needs adjustment, the method 800 can include one or more of the following steps (in no particular order): determining whether the cam button(s) of the hood hinges need adjusting (step 824); determining whether the position of the hinge arm(s) need adjusting (step 828); and/or determining whether the position of the base(s) need adjusting (step 832). In some cases, the method 800 includes all of the steps described in this paragraph. In other cases, one or more of steps 824, 828, and 832 can be omitted.

To adjust a position of the vehicle hood relative to the vehicle body, the method 800 can include the step 826 of adjusting the cam button(s); the step 830 of threadingly adjusting a position of the threaded fastener(s) of the hinge arm(s); and/or the step 834 of adjusting a position of the threaded fastener(s) of the base(s). For example, if it is determined at step 824 that the cam button(s) need adjusting, an orientation of one or more of the cam buttons of each hood hinge can be adjusted in step 826 to adjust a position of the corresponding hinge arm(s). If it is determined at step 828 that the position of the hinge arm(s) needs adjusting, the position of one or both of the first and second body attachment member threaded fasteners can be threadingly adjusted in step 830 to adjust the position of the hinge arm(s) and press the corresponding front attachment bolt(s) in order to adjust a position of the corresponding hinge arm(s). If it is determined at step 832 that the position of the base(s) needs adjusting, the method can include the step 834 of adjusting one or more threaded fasteners to press the corresponding body attachment bolt(s) to adjust the position of the corresponding base(s). Further discussion of each of these positional adjustment steps is included elsewhere herein.

In some cases, the method 800 can also include the step 836 of making other positional adjustments (i.e., adjustments other than those specifically described herein) to adjust a position of the vehicle hood relative to the vehicle body. For example, if it is determined at step 820 that the hood position needs adjusting, but the cam buttons do not need adjusting (i.e., step 824: NO); the hinge arm(s) do not need adjusting (i.e., step 828: NO); and the base(s) do not need adjusting (i.e., step 832: NO), then other positional adjustments can be made at step 836.

As shown in FIG. 8, after any of steps 826, 830, 834, and 836, the method 800 can return to step 820 to determine if the hood position still needs adjusting. In many instances, one or more of steps 826, 830, 834, and 836 may be performed more than once in an iterative manner to adjust the hood position. It should be understood that steps 826, 830, 834, and 836 can be performed in any order depending on what is necessary to create optimum fit between the vehicle hood and the vehicle body. The method 800 can continue until it is determined that the hood hinge no longer needs positioning (i.e., step 822: NO). At that point, the method 800 may come to an end at step 822.

Various examples have been described with reference to certain disclosed embodiments. The embodiments are presented for purposes of illustration and not limitation. One skilled in the art will appreciate that various changes, adaptations, and modifications can be made without departing from the scope of the invention.

The invention claimed is:

1. A hood hinge, comprising:

a body attachment member configured to be attached to a body of a vehicle;

a hood attachment member configured to be attached to a hood of the vehicle; and a hinge mechanism connected to the body attachment member and the hood attachment member, the hinge mechanism being configured to enable hinged movement of the hood relative to the body, wherein the body attachment member or the hood attachment member comprises:

an attachment arm configured to attach to the body or the hood, the attachment arm including a first attachment opening that comprises a first attachment slot and a second attachment opening that comprises a second attachment slot, and a first cam assembly that includes a first cam button and a first bolt, the first bolt being configured to attach the attachment arm to the body or the hood while positioning the first cam button in the first attachment opening, a second cam assembly that includes a second cam button and a second bolt, the second bolt being configured to attach the attachment arm to the body or the hood while positioning the second cam button in the second attachment opening, wherein the first cam assembly is configured to permit adjustment of a position of the body or the hood relative to the attachment arm in a first direction, wherein the second cam assembly is configured to permit adjustment of the position of the body or the hood relative to the attachment arm in the first direction independent of the first cam assembly permitting adjustment of the position of the body or the hood relative to the attachment arm in the first direction, and wherein the first attachment slot and the second attachment slot are configured to permit adjustment of the position of the body or the hood relative to the attachment arm in a second direction.

2. The hood hinge of claim 1, wherein the hood attachment member comprises the attachment arm and the first and second cam assemblies.

3. The hood hinge of claim 2, wherein the hood attachment member further comprises a hood attachment member threaded fastener extending into the first attachment slot, the hood attachment member threaded fastener being configured to press the first cam assembly to facilitate controlled adjustment of the position of the hood relative to the attachment arm in the second direction.

4. The hood hinge of claim 3, wherein the first attachment slot is open-ended to facilitate initial placement of the first cam button in the first attachment slot.

5. The hood hinge of claim 4, wherein the body attachment member comprises:

a base with first and second body attachment slots, first and second body attachment bolts configured to fit in the first and second body attachment slots, respectively, wherein the first and second body attachment bolts are configured to attach the base to the body of the vehicle, and first and second body attachment member threaded fasteners extending into the first and second body attachment slots, respectively, wherein the first and second body attachment member threaded fasteners are configured to press the first and second body attachment bolts, respectively, to permit independent adjustment of a position of the body relative to the base.

6. The hood hinge of claim 3, wherein the body attachment member comprises:

a base with first and second body attachment slots, first and second body attachment bolts configured to fit in the first and second body attachment slots, respectively, wherein the first and second body attachment bolts are configured to attach the base to the body of the vehicle, and first and second body attachment member threaded fasteners extending into the first and second body attachment slots, respectively, wherein the first and second body attachment member threaded fasteners are configured to press the first and second body attachment bolts, respectively, to permit independent adjustment of a position of the body relative to the base.

7. The hood hinge of claim 2, wherein the first attachment slot is open-ended to facilitate initial placement of the first cam button in the first attachment slot.

8. The hood hinge of claim 7, wherein the body attachment member comprises:

a base with first and second body attachment slots, first and second body attachment bolts configured to fit in the first and second body attachment slots, respectively, wherein the first and second body attachment bolts are configured to attach the base to the body of the vehicle, and first and second body attachment member threaded fasteners extending into the first and second body attachment slots, respectively, wherein the first and second body attachment member threaded fasteners are configured to press the first and second body attachment bolts, respectively, to permit independent adjustment of a position of the body relative to the base.

9. The hood hinge of claim 2, wherein the body attachment member comprises:

a base with first and second body attachment slots, first and second body attachment bolts configured to fit in the first and second body attachment slots, respectively, wherein the first and second body attachment bolts are configured to attach the base to the body of the vehicle, and first and second body attachment member threaded fasteners extending into the first and second body attachment slots, respectively, wherein the first and second body attachment member threaded fasteners are configured to press the first and second body attachment bolts, respectively, to permit independent adjustment of a position of the body relative to the base.

10. A hood hinge, comprising:

a body attachment member configured to be attached to a body of a vehicle;

a hood attachment member configured to be attached to a hood of the vehicle, the hood attachment member comprising a hinge arm and a first cam assembly configured to attach the hinge arm to the hood, the first cam assembly being configured to permit adjustment of a position of the hood relative to the hinge arm; and a hinge mechanism connected to the body attachment member and the hood attachment member, the hinge mechanism being configured to enable hinged movement of the hood relative to the body, wherein the body attachment member comprises:

a base with first and second attachment slots, first and second attachment bolts configured to fit in the first and second attachment slots, respectively, wherein the first and second attachment bolts are configured to attach the base to the body, and a first attachment member threaded fastener extending into the first attachment slot, wherein the first attachment member threaded fastener is configured to press the first attachment bolt, to permit adjustment of a position of the body relative to the base.

11. The hood hinge of claim 10, wherein the body attachment member further comprises a second attachment member threaded fastener extending into the second attachment slot, wherein the second attachment member threaded fastener is configured to press the second attachment bolt, to permit adjustment of the position of the body relative to the base.

12. The hood hinge of claim 11, wherein the body attachment member further comprises:

a third attachment slot in the base, a third attachment bolt configured to fit in the third attachment slot, the third attachment bolt being configured to attach the base to the body, and a third attachment member threaded fastener extending into the third attachment slot, wherein the third attachment member threaded fastener is configured to press the third attachment bolt to permit independent adjustment of the position of the body relative to the base.

13. The hood hinge of claim 10, wherein:

the hinge arm includes a first hood attachment slot and a second hood attachment slot, and the hood attachment member further comprises:

first and second hood attachment bolts configured to attach the hinge arm to the hood while extending through the first and second hood attachment slots, respectively, and a hood attachment member threaded fastener extending into the first hood attachment slot, the hood attachment member threaded fastener being configured to press the first hood attachment bolt to facilitate controlled adjustment of a position of the hood relative to the hinge arm in a first direction.

14. The hood hinge of claim 13, wherein the first hood attachment slot is open-ended to facilitate initial placement of the first hood attachment bolt in the first hood attachment slot.

15. The hood hinge of claim 10, wherein:

the hinge arm includes a first hood attachment slot and a second hood attachment slot, and the hood attachment member further comprises first and second hood attachment bolts configured to attach the hinge arm to the hood while extending through the first and second hood attachment slots, respectively, and the first hood attachment slot and the second hood attachment slot are configured to permit adjustment of a position of the hood relative to the hinge arm in a first direction, and the first hood attachment slot is open-ended to facilitate initial placement of the first hood attachment bolt in the first hood attachment slot.

16. The hood hinge of claim 10, wherein the body attachment member further comprises a second attachment member threaded fastener extending into the second attachment slot, wherein the second attachment member threaded fastener is configured to press the second attachment bolt, to permit adjustment of the position of the body relative to the base.

17. The hood hinge of claim 16, wherein the body attachment member further comprises:

a third attachment slot in the base, a third attachment bolt configured to fit in the third attachment slot, the third attachment bolt being configured to attach the base to the body, and a third attachment member threaded fastener extending into the third attachment slot, wherein the third attachment member threaded fastener is configured to press the third attachment bolt to permit independent adjustment of the position of the body relative to the base.

18. The hood hinge of claim 10, wherein the hood attachment member further comprises a second cam assembly configured to attach the hinge arm to the hood, the second cam assembly being configured to permit adjustment of the position of the hood relative to the hinge arm.

19. A hood hinge, comprising:

a body attachment member configured to be attached to a body of a vehicle, the body attachment member comprising:

a base with first and second attachment slots, first and second attachment bolts configured to fit in the first and second attachment slots, respectively, wherein the first and second attachment bolts are configured to attach the base to the body, and a first attachment member threaded fastener extending into the first attachment slot, wherein the first attachment member threaded fastener is configured to press the first attachment bolt, to permit adjustment of a position of the body relative to the base;

a hood attachment member configured to be attached to a hood of the vehicle, the hood attachment member comprising:

a hinge arm configured to attach to the hood, the hinge arm including a first hood attachment slot and a second hood attachment slot, and first and second hood attachment bolts configured to attach the hinge arm to the hood while extending through the first and second hood attachment slots, respectively, and wherein the first hood attachment slot and the second hood attachment slot are configured to permit adjustment of a position of the hood relative to the hinge arm in a first direction, and wherein the first hood attachment slot is open-ended to facilitate initial placement of the first hood attachment bolt in the first hood attachment slot; and a hinge mechanism connected to the body attachment member and the hood attachment member, the hinge mechanism being configured to enable hinged movement of the hood relative to the body.

20. The hood hinge of claim 19, wherein the hood attachment member further comprises a first cam assembly that includes a first cam button and the first hood attachment bolt, the first hood attachment bolt being configured to attach the hinge arm to the hood while positioning the first cam button in the first hood attachment slot, the first cam assembly being configured to permit adjustment of the position of the hood relative to the hinge arm in a second direction.

21. The hood hinge of claim 20, wherein the hood attachment member further comprises a second cam assembly that includes a second cam button and the second hood attachment bolt, the second hood attachment bolt being configured to attach the hinge arm to the hood while positioning the second cam button in the second hood attachment slot, the second cam assembly being configured to permit adjustment of the hood relative to the hinge arm in the second direction independent of the first cam assembly permitting adjustment of the position of the hood relative to the hinge arm in the second direction.

22. The hood hinge of claim 21, wherein the hood attachment member further comprises a hood attachment member threaded fastener extending into the first attachment slot, the hood attachment member threaded fastener being configured to press the first cam assembly to facilitate controlled adjustment of the position of the hood relative to the hinge arm in the first direction.

* * * * *